US006137451A

United States Patent [19]

Durvasula et al.

[11] Patent Number: 6,137,451

[45] **Date of Patent: *Oct. 24, 2000**

[54] MULTIPLE BEAM BY SHAPED REFLECTOR ANTENNA

[75] Inventors: Bhaskar Durvasula, Mountain View; Terry M. Smith, La Honda, both of Calif.

[73] Assignee: Space Systems/Loral, Inc., Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/961,169

[22] Filed: Oct. 30, 1997

[51] Int. Cl.[7] ..... H01Q 15/16; H01Q 19/12

[52] U.S. Cl. ..... 343/835; 343/779; 343/840

[58] Field of Search ..... 343/835, 914, 343/781 R, 776, 777, DIG. 2, 840, 779; H01Q 19/12, 15/16

[56] References Cited

U.S. PATENT DOCUMENTS

| | | | |
|---|---|---|---|
| 3,435,453 | 3/1969 | Howard | 343/777 |
| 3,534,365 | 10/1970 | Korvin et al. | 343/777 |
| 3,569,976 | 3/1971 | Korvin et al. | 343/777 |
| 3,898,667 | 8/1975 | Raab | 343/756 |
| 4,647,938 | 3/1987 | Roederer et al. | 343/756 |
| 5,202,700 | 4/1993 | Miller | 343/914 |
| 5,546,097 | 8/1996 | Ramanujam et al. | 343/781 CA |
| 5,576,721 | 11/1996 | Hwang et al. | 343/781 CA |
| 5,581,265 | 12/1996 | Stirland et al. | 343/756 |

*Primary Examiner*—Michael C. Wimer
*Attorney, Agent, or Firm*—Perman & Green, LLP

[57] ABSTRACT

An antenna system has a reflector illuminated by a primary feed for producing a primary beam. The reflector is illuminated further by a secondary feed formed of an array of secondary feed elements of which the respective electromagnetic signals are adjustable in terms of their relative amplitudes and phases to produce a secondary beam with sidelobes oriented in directions away from the directions of the primary beam. Spacing among feed elements of the secondary feed array is selected for further control of orientation of sidelobes of the secondary beam. Highest efficiency is attained for signals of the primary feed by configuring the reflector for forming the primary beam, while the secondary beam is produced with lower efficiency but with isolation from the primary beam. The surface of the reflector is contoured to provide maximum primary-beam efficiency and minimal primary-beam sidelobes in the direction of the secondary beam.

6 Claims, 4 Drawing Sheets

MULTIPLE BEAM BY SHAPED REFLECTOR ANTENNA

BACKGROUND OF THE INVENTION

This invention relates to an antenna having a reflector and a primary feed illuminating the reflector, the reflector serving to establish a cross-sectional configuration of a primary beam, wherein the antenna includes a secondary feed comprising an array of feed elements illuminating the reflector to produce a secondary beam with control of sidelobes away from a direction of the primary beam.

An antenna constructed of a reflector illuminated by a feed may be employed in a situation wherein the antenna is required to generate plural beams of electromagnetic radiation. By way of example, in a satellite communication system, a satellite carrying such an antenna encircles the earth in a stationary orbit. The antenna produces the plural beams for simultaneous illumination of plural regions of the earth. Each of the beams has a prescribed cross-sectional configuration for producing a desired footprint at each of the respective illuminated regions of the earth.

A feature in the construction of an antenna comprising a reflector illuminated by a feed is the shaping of the reflector for configuring the rays of radiation from the feed into a beam of desired cross-sectional configuration. This provides optimum efficiency in the transference of electromagnetic power from the feed to the illuminated region.

To develop a second beam angled in direction relative to the primary beam of the primary feed, a secondary feed is positioned for illuminating the reflector, the two feeds being spaced apart so as to introduce the angulation between the two beams. Since the reflector has been configured for optimizing efficiency of the primary feed, the efficiency of transmission of radiant energy from the secondary feed occurs at a lower efficiency. Nevertheless, such an antenna is able to illuminate two separate regions of the earth's surface by the two beams.

However, a problem arises in that the beams may have sidelobes in their respective radiation patterns with the result that a sidelobe of the primary beam may interfere with the propagation of signals from the main lobe of the secondary beam. Similarly, a sidelobe of the secondary beam may be oriented in the direction of the main lobe of the primary beam so as to interfere with the transmission of signals by the primary beam. It is, therefore, desirable to construct the antenna in a manner which avoids interference of the sidelobe of one beam within the main lobe of the other beam. However, a construction of antenna which introduces sufficient isolation of the plural beams has not been available heretofore, and separate antennas have been required for the generation of the separate beams.

SUMMARY OF THE INVENTION

The aforementioned problem is overcome and other advantages are provided by an antenna, constructed in accordance with the invention, wherein the antenna includes a reflector illuminated by both a primary feed and a secondary feed for generating plural beams while maintaining isolation between the respective beams.

The invention provides for a reflector and a primary feed positioned for illuminating the reflector, wherein the reflector is configured for reflecting the radiation of the primary feed to form a beam of desired cross section. This optimizes efficiency of transmission of the electromagnetic power in the sense that virtually all of the power radiated by the primary feed is captured within the footprint. Typically, the primary feed comprises a single radiating element, such as a horn, but may, if desired, comprise a plurality of radiating elements, such as a cluster of four horns. The antenna of the invention includes also a secondary feed which is offset in position from the primary feed, and which also illuminates the reflector for generation of a secondary beam produced by the reflector. The secondary beam is oriented in a direction angled relative to the direction of the primary beam. The secondary beam is less efficient in the transmission of radiant energy from the secondary feed due to the fact that the reflector has been shaped specifically for coverage by the primary beam.

In the construction of the antenna, it is recognized that sidelobes of the primary beam are dependent on the cross-sectional configuration of the reflector and the surface contour of the reflector. By way of example in a typical construction of the antenna, a diameter of the radiating aperture of the reflector is on the order of 50 to 100 times as great as the diameter of the radiating aperture of the primary feed. By increasing the diameter of the radiating aperture of the reflector, the sidelobes of the primary beam can be brought closer, in terms of angulation, to the main lobe of the primary beam. In order to minimize interference with transmissions of the secondary beam, the reflector is shaped to suppress primary-beam sidelobes in the secondary-beam direction. Furthermore, the reflector is specifically shaped with a surface contour which directs lobes of the primary beam in directions away from the axis of the secondary beam.

In accordance with a further aspect of the invention, the secondary feed is constructed of an array of feed elements which results in the generation, in cooperation with the reflector, of the secondary beam which comprises both a main lobe and sidelobes. The configuration of the reflector has already been established for optimizing the configuration of the primary beam. Accordingly, optimization of the configuration of the secondary beam is accomplished by a selection of spacings among the feed elements in the array, by use of a phase taper to signals transmitted by the respective feed elements of the array, and by adjustment of the relative amplitudes of the signals transmitted by the respective elements of the array. The parameters of spacing, phasing and amplitude are employed to configure the secondary beam by adjustment of the orientations of the sidelobes relative to the main lobe. In particular, the sidelobes are positioned such that there is essentially no sidelobe radiation being transmitted in the direction of the main lobe of the primary beam. Thereby, the invention has attained the desired isolation between signals transmitted via the main lobes of the primary and the secondary beams.

BRIEF DESCRIPTION OF THE DRAWINGS

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION

Figure 1:
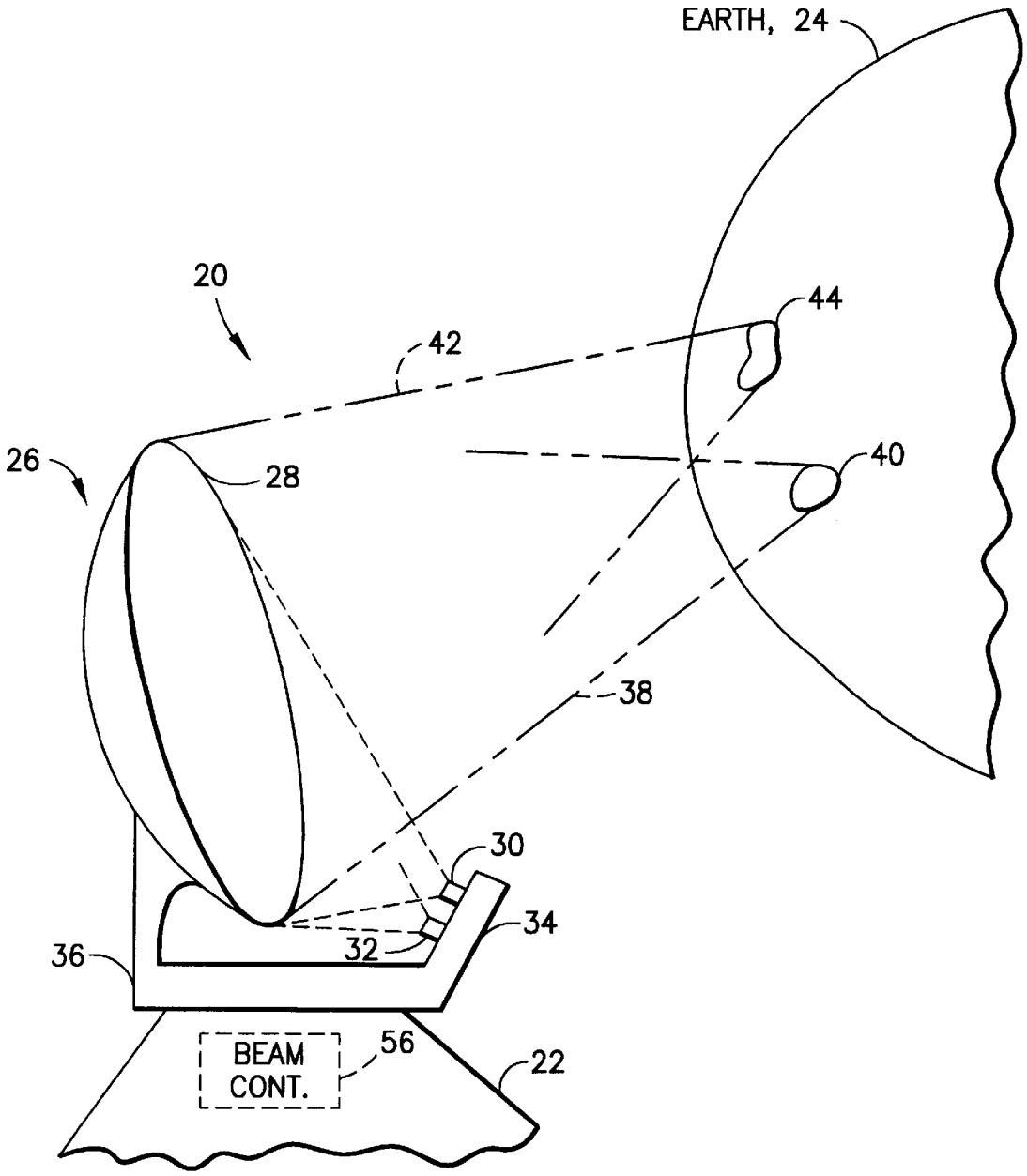
FIG. 1 is a stylized view of a satellite carrying the antenna of the invention while circling the earth.

FIG. 1 shows a communication system 20 having a satellite 22 which encircles the earth 24. The satellite 22 carries an antenna 26 constructed in accordance with the invention and having a reflector 28 illuminated by a primary feed 30 and a secondary feed 32. The feeds 30 and 32 constitute a feed assembly 34 which is positioned by a frame 36 relative to the reflector 28. The primary feed 30 transmits radiation to the reflector 28 which reflects the radiation to form a primary beam 38 which illuminates a portion of the earth as shown by a primary beam footprint 40. The secondary feed 32 transmits radiation to the reflector 28 which reflects the radiation to form a secondary beam 42 which illuminates a separate portion of the earth indicated by a secondary beam footprint 44.

Figure 2:
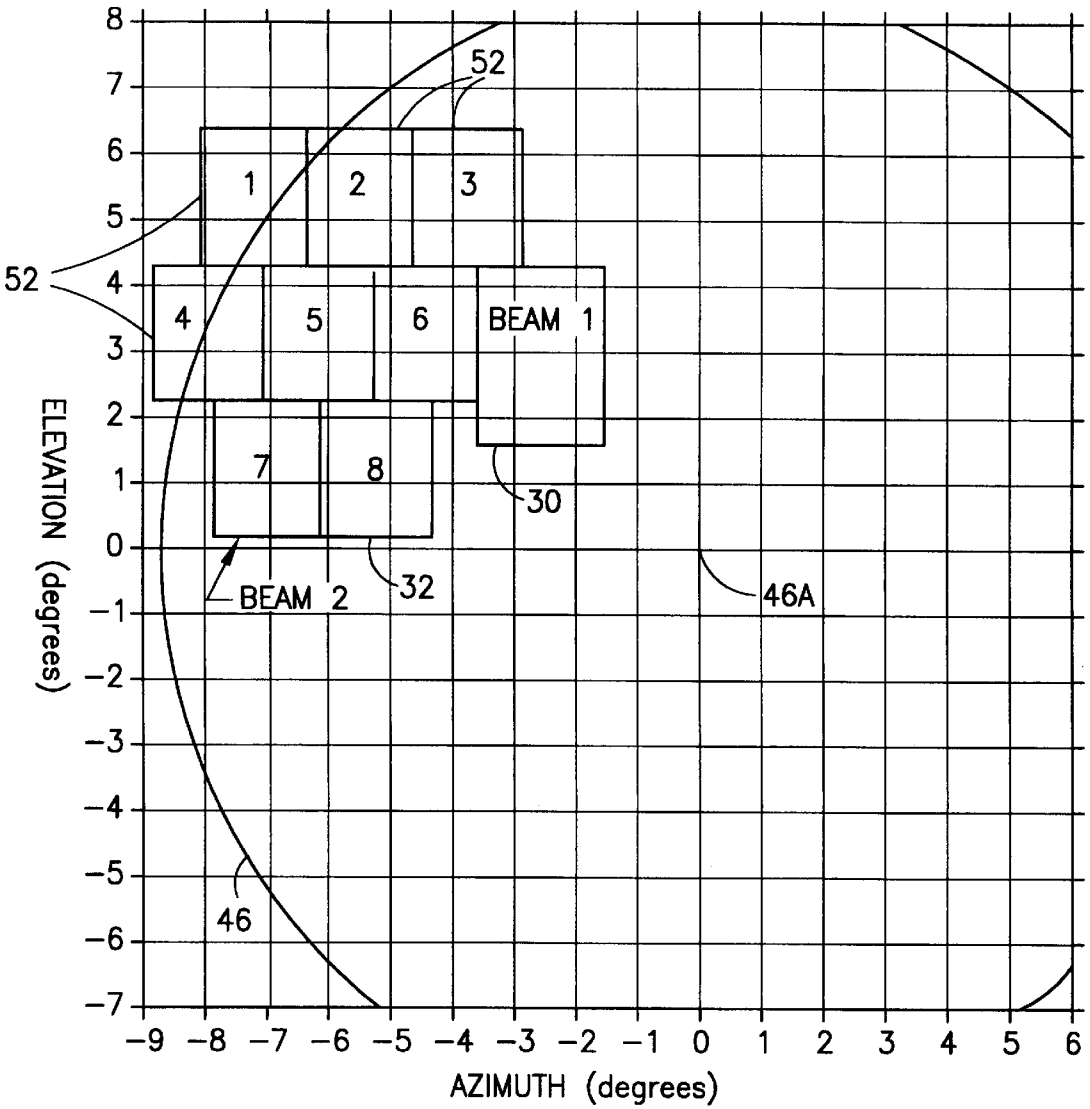
FIG. 2 is a diagram showing an arrangement of feed elements in a feed assembly of the antenna of FIG. 1.

FIG. 2 shows a system of coordinate axes of azimuth and elevation superposed upon a circle 46 (partially shown) which represents the projection of angles to the earth upon the feed assembly 34. The intersection of zero degrees in azimuth and zero degrees in elevation represents the center 46A of the circle 46. The primary feed 30 is shown in FIG. 2, and is represented by a rectangular radiating aperture identified as Beam 1. The secondary feed 32 has a complex shape comprising, by way of example, eight feed elements 52, further identified by the numerals 1–8, and collectively identified as Beam 2. The center of the array of feed elements 52 is displaced from the center of the primary feed 30.

Figure 3:
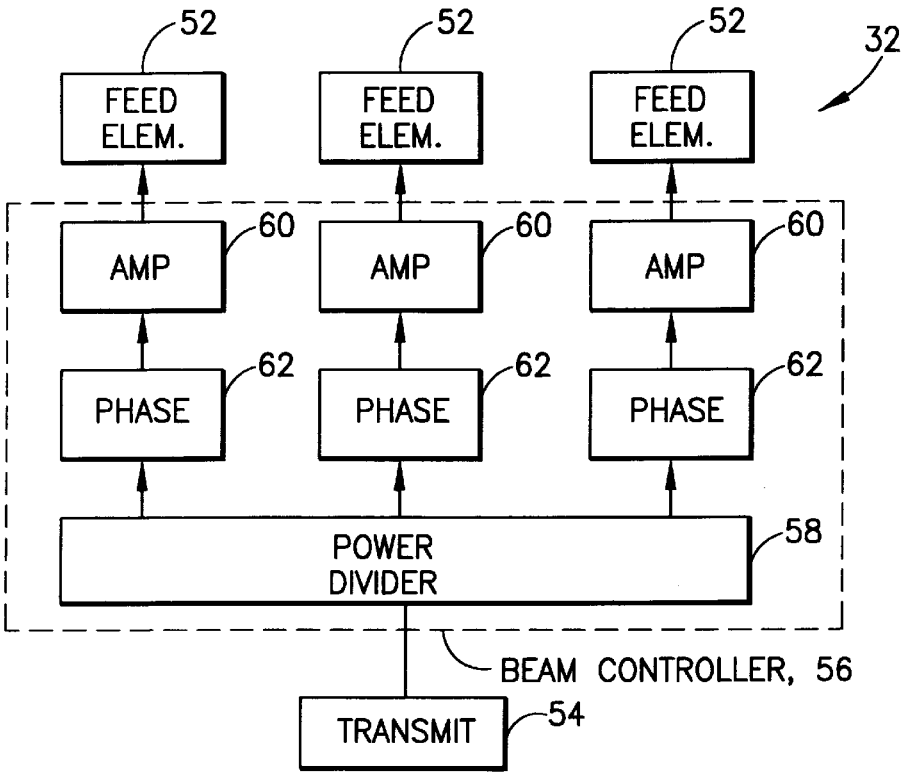
FIG. 3 is a block diagram showing components of a beam controller for the antenna of FIG. 1.

In FIG. 3, the feed elements 52 of the secondary feed 32 radiate an electromagnetic signal provided by a transmitter 54 connected to individual ones of the feed elements 52 by a beam controller 56, also shown in FIG. 1. Only three of the radiating elements 52 are shown in FIG. 3 to simplify the drawing. The beam controller 56 comprises a power divider 58 which divides the power of the transmitter 54 among respective signal channels for respective ones of the feed elements 52, wherein each signal channel comprises an amplifier 60 and a phase shifter 62. Each of the amplifiers 60 has a gain which is preset, and each of the phase shifters 62 is preset to a specifc amount of phase shift to provide the desired configuration to the secondary beam.

It is noted that the description of the beam controller 56 and the transmitter 54 is provided for the situation wherein the secondary feed 32 is transmitting radiant energy for the formation of a beam by the reflector 28 (FIG. 1). However, it is to be understood that the teachings of the invention apply also to the case wherein the secondary feed 32 is receiving a signal via the secondary beam 42 (FIG. 1) in which case the beam controller 56 would include a power combiner (not shown) coupled to a receiver (not shown). In the case of the receiving of signals, each of the signal channels of the respective feed elements 52 would include a phase shifter, such as the phase shifter 62, and an amplifier including an adjustable attenuator (not shown). For the receiving of signals, the signal amplitudes and phases are adjustable electronically by signals stored in the memory 64.

Figure 4:
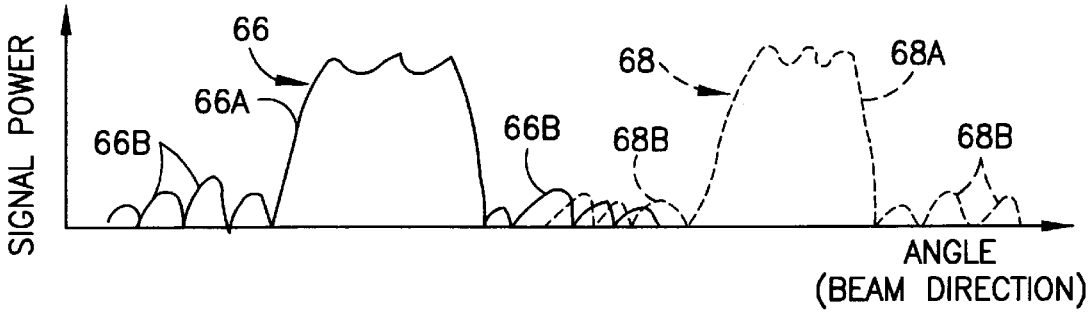
FIG. 4 shows radiation patterns of a primary beam and a secondary beam for the antenna of FIG. 1.

FIG. 4 shows an antenna radiation pattern 66, presented in solid lines, of the primary beam 38 (FIG. 1) produced by radiation of the primary feed 30. FIG. 4 also shows an antenna radiation pattern 68, presented in dashed lines, of the secondary beam 42 (FIG. 1) provided by radiation from the secondary feed 32. The radiation pattern 66 has a main lobe 66A and a plurality of sidelobes 66B. The radiation pattern 68 also has a main beam 68A and a plurality of sidelobes 68B. The invention provides for a configuring of the radiation patterns 66 and 68 such that the sidelobes of one of the patterns 66 and 68 do not interfere with the main lobes of the other of the radiation patterns 66 and 68.

Figure 5:
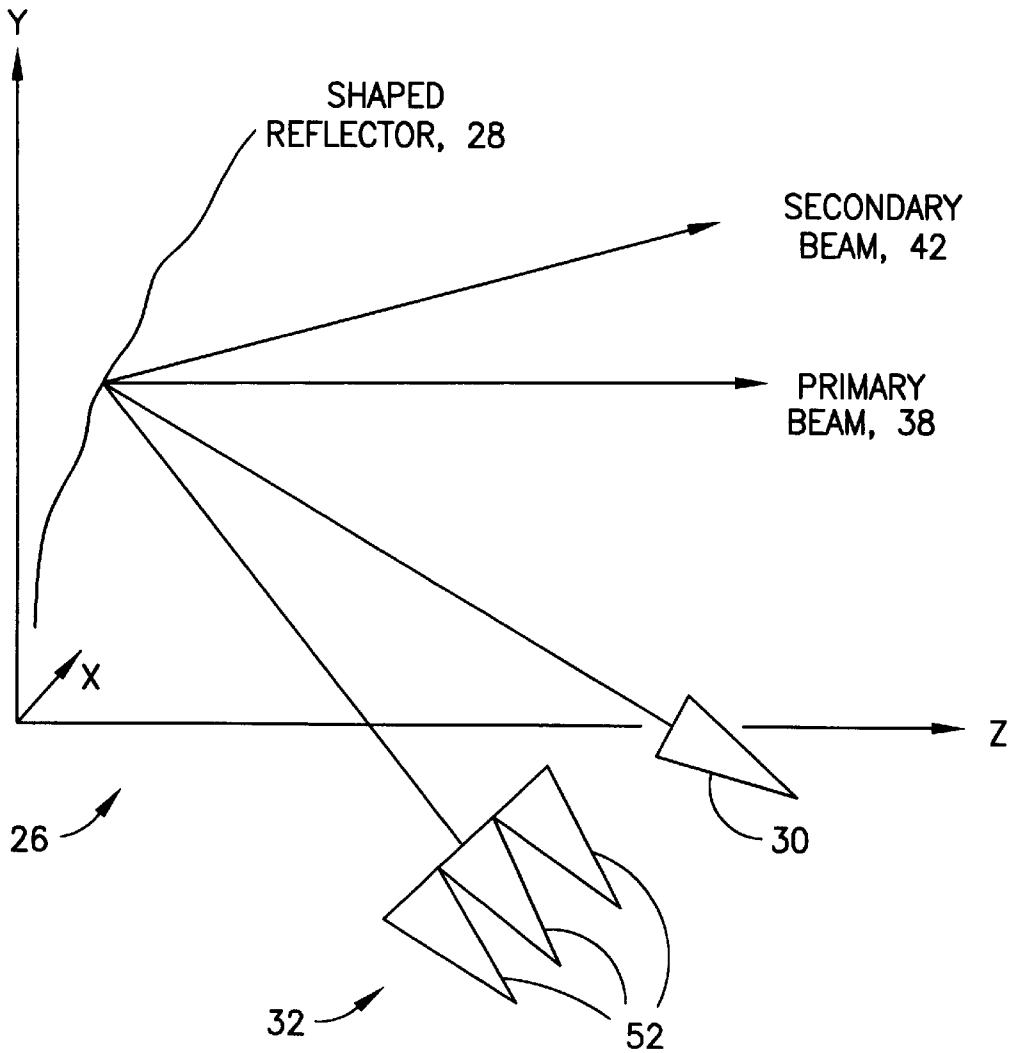
FIG. 5 shows diagrammatically the relative orientations of the primary beam and the secondary beam produced, respectively, by a primary feed and an array of secondary feed elements in the antenna of FIG. 1.

The generation of the primary beam 38 and the secondary beam 42 are shown also in the diagram of FIG. 5 wherein the components of the antenna 26 (FIG. 1) are shown diagrammatically superposed upon a system of coordinate axes X, Y and Z. The shaping of the reflector 28 to provide a specific configuration of beam is represented by a wavy line. The offsetting of the feed 30 and the feed elements 52 of the feed 32 is indicated also with reference to the X, Y, Z coordinate axes. To simplify the drawing, only three of the feed elements 52 of the secondary feed 32 are shown. The center of the secondary feed 32 is offset from the center of the feed 30 resulting in angulation of the primary beam 38 relative to the secondary beam 42.

In the operation of the invention, the angulation of the primary beam 38 relative to the secondary beam 42 is selected in accordance with the mission of the satellite 22 (FIG. 1) for illuminating the spaced apart regions of the earth, as represented by the footprints 40 and 44. In accordance with a feature of the invention, the configuration of the reflector 28, the configuration of the array of the feed elements 52 of the secondary feed 32, the relative amplitudes of the signals of the respective feed elements 52, and the relative phases among the signals of the respective feed elements 52 establish the relationship among the lobes of the radiation patterns 66 and 68 of the primary beam 30 and the secondary beam 32 wherein, as noted hereinabove, the sidelobes of one of the radiation patterns does not interfere with the other of the radiation patterns.

In the case wherein the primary feed 30 has only one feed element, as has been depicted in FIGS. 2 and 5, adjustment of the lobe structure of the primary radiation pattern 66 is obtained by selection of the cross-sectional and surface shaping dimensions of the radiating aperture of the reflector 28. Typically, in the construction of the antenna, a diameter of the radiating aperture of the reflector 28, by way of example, is on the order of 50 to 100 times as great as the diameter of the radiating aperture of the primary feed 30. A larger radiating aperture decreases angular spacing among the sidelobes 66B and a smaller radiating aperture enlarges the angular spacing among the sidelobes 66B. In particular, the angular spacing among the sidelobes 66B of the primary radiation pattern 66 are selected to provide for essentially zero radiation in the direction of the main lobe 68A of the secondary radiation pattern 68 by appropriate shaping of the surface contour of the reflector.

Furthermore, in the secondary feed 32, the spacings of the feed elements 52 relative to each other, the amplitudes of the respective signals radiated by the feed elements 52, and the phasing among the signals of the respective feed elements 52 are selected to adjust the angular spacing among the sidelobes 68B of the secondary radiation pattern 68 to insure that there is essentially no sidelobe radiation from any of the sidelobes 68B in the direction of the main lobe 66A of the primary radiation pattern 66. In the consruction of the secondary feed 32, typically, spacings between neighboring ones of the feed elements 52 are in the range of 0.5 to 5.0 wavelengths of the radiation emittd by the respective feed elements 52. The foregoing control of the relative angular locations of the respective sidelobes of the radiation pattern

66 and 68 can be obtained in the situation wherein the signals radiated by the feeds 30 and 32 are at the same frequency or at different frequencies, as well as at the same polarization or at different polarizations.

In this way, the invention has provided for the generation of separate beams by use of separate feeds with a common reflector. This is accomplished by development of radiation patterns of interlaced lobe structure such that a lobe of one radiation pattern does not interfere with the radiation from the main lobe of the other radiation pattern. Since the reflector of the antenna has been configured to optimize efficiency of only one of the feeds, this being the primary feed 30, the foregoing advantage of improved isolation among the beams is attained at a cost of reduced efficiency of transmission of the signal of the secondary feed 32.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An antenna system comprising:

a reflector and a primary feed positioned for illuminating the reflector to produce a primary beam;

a secondary feed positioned for illuminating said reflector to produce a secondary beam angled relative to said primary beam;

wherein said secondary feed comprises an array of secondary feed elements positioned relative to each other with predetermined values of spacing for establishing directions of side lobes of said secondary beam;

a surface of the reflector is contoured for radiation of primary beam power at an efficiency of radiation greater than an efficiency of radiation of secondary beam power, a shape and a diameter of the reflector providing the reflector with a characteristic of offsetting directions of primary-beam sidelobes from a direction of radiation of the main lobe of the secondary beam; and the system further comprises means for establishing relative phases and amplitudes among signals of respective ones of said secondary feed elements for adjustment of said sidelobes of said secondary beam to offset each of said sidelobes of said secondary beam away from a direction of the main lobe of said primary beam.

2. A system according to claim 1 wherein said predetermined values of spacing are in a range of approximately 0.5 wavelengths to 5.0 wavelengths of radiation emanating from said secondary feed.

3. A system according to claim 2 wherein a diameter of the reflector exceeds a diameter of the array of said secondary feed elements by a factor in a range of approximately 50 to 100.

4. A system according to claim 3 wherein said factor effects an orientation of a sidelobe of said primary beam relative to a main lobe of said primary beam, said factor having a value for offsetting the sidelobes of said primary beam relative to a direction of said secondary beam.

5. A system according to claim 1 wherein the contour of the surface of said reflector provides for a maximum efficiency of radiation of said primary beam.

6. A method of modifying an antenna having a reflector illuminated by a primary feed to accept a secondary feed for generation of both primary and secondary beams angled relative to each other, the method comprising steps of:

constructing the secondary feed of an array of feed elements;

locating the secondary feed relative to the reflector for illuminating the reflector, said locating including an offsetting of a position of the secondary feed relative to the primary feed;

establishing values of spacing among the feed elements of the secondary feed, values of phasing of signals among the feed elements of the secondary feed, and values of amplitude of the signals among the feed elements of the secondary feed to establish a radiation pattern of the secondary beam having all lobes offset from a main lobe of the primary beam; and shaping the reflector and providing a diameter for the reflector for angling sidelobes of the primary beam away from the direction of the main lobe of the secondary beam.

* * * * *